US006793201B2

(12) United States Patent
Harrah et al.

(10) Patent No.: US 6,793,201 B2
(45) Date of Patent: Sep. 21, 2004

(54) METHOD AND APPARATUS FOR WINCHING

(76) Inventors: Eric A. Harrah, 211 E. South St., Bloomfield, IN (US) 47424; Patrick F Simpson, 266 W. Post St., Bloomfield, IN (US) 47424

( * ) Notice: Subject to any disclaimer, the term of this patent is extended or adjusted under 35 U.S.C. 154(b) by 0 days.

(21) Appl. No.: 10/405,815

(22) Filed: Apr. 2, 2003

(65) Prior Publication Data

US 2003/0218161 A1 Nov. 27, 2003

Related U.S. Application Data

(62) Division of application No. 10/154,307, filed on May 23, 2002, now Pat. No. 6,595,490.

(51) Int. Cl.[7] ..... B66F 3/00
(52) U.S. Cl. ..... 254/108; 254/132
(58) Field of Search ..... 254/132, 325, 254/328, 108, 380; 242/392, 95

(56) References Cited

U.S. PATENT DOCUMENTS

| | | | | | |
|---|---|---|---|---|---|
| 382,096 | A | * | 5/1888 | Lafo | 254/218 |
| 4,343,457 | A | * | 8/1982 | Siano | 254/43 |
| 5,431,371 | A | * | 7/1995 | Daniels et al. | 254/218 |
| 5,462,385 | A | * | 10/1995 | Mohlengraft | 404/25 |

* cited by examiner

*Primary Examiner*—Robert C. Watson
(74) *Attorney, Agent, or Firm*—Woodard, Emhardt, Moriarty, McNett & Henry LLP

(57) ABSTRACT

A process for winching comprising attaching a first line to a jack, connecting a second line to the object to be winched, connecting a third line to the running gear of the jack, immobilizing the jack, connecting the third line to the second line and cranking the jack to move the object, and connecting the first line to the second line to hold the object in its new position. Apparatus for holding an object being winched in a new position including a winch tensioner bracket connected to a grab hook by a chain.

3 Claims, 6 Drawing Sheets

METHOD AND APPARATUS FOR WINCHING

BACKGROUND OF THE INVENTION

This application is a divisional and claims priority to U.S. patent application Ser. No. 10/154,307 filed May 23, 2002 now U.S. Pat. No. 6,595,490.

DESCRIPTION OF THE RELEVANT ART

Lifting jacks are commonly available inexpensive tools that are used to raise and lower loads. Such lifting jacks may be of the type shown in the early Harrah U.S. Pat. Nos. 1,307,968, 1,374,653 and 1,482,846 as well as the McIntosh U.S. Pat. No. 4,379,546, all of which are incorporated herein by reference. The general operation of such jacks has remained the same for many years. The design includes a standard or bar with a series of spaced apertures and a pair of climbing pins which alternately fit into these apertures as their corresponding runners move along the bar in a step-by-step fashion which is controlled by a handle (lever). A reversing mechanism enables the runners to be moved along the bar, intermittently, in either direction. Also the runners also known as running gear can be slid down the bar if there is no load on the running gear.

This type of jack is frequently mounted on trucks as a standard tool for use on the farm and in backcountry. Of course the primary purpose of the jack is for lifting the vehicle but it can also be used as a winch. Such a jack is shown in FIG. 1. Winching with such a jack prior to the present invention was accomplished by securing the top clamp 10 of the jack to a heavy stationary object by means of a chain. For example, this could be accomplished by attaching to a tree. The nose 11 of the jack is then secured to another chain that is attached to the frame of the vehicle. The lever 12 is then cranked causing the running gear 15 of the jack upon which the nose is mounted to gradually move up the I-beam or bar 16 by stepping along the evenly spaced apertures 17.

Typically, the length of the bar is sufficient to allow about four feet of movement and therefore the slack in the chain had to first be removed before any movement of the vehicle would occur. It is also then necessary to put chocks under the wheels of the vehicle to hold it in the new position while the chain is readjusted in order to pull it further. This process has to be performed as many times as needed in order to move the vehicle to the solid ground.

The problems with this process are that after the chains are all fastened and the winch process is ready to begin the slack must be removed before the jack actually starts to winch the vehicle. Removing the slack could cost the operator as much as two feet of the jack's bar. The complete travel of the bar is only four feet so the operator just performed this complicated process to winch his vehicle approximately two feet. If the vehicle needed to be winched 20 feet, this process could take 10 times the effort and time. The second problem is that the vehicle must be chocked each cycle performed to keep from losing the ground gained.

SUMMARY OF THE INVENTION

One embodiment of the process of the present invention for winching involves providing a jack including a bar having a top and a base and running gear mounted on the bar and movable between the base and the top. A winch tensioner bracket is mounted with an attached first chain on the bar at the base. A second chain is connected to the object to be winched. The process further comprises mounting a winch jack attachment bracket on the running gear with a third chain extending from the winch jack attachment bracket. A fourth chain is connected between the stationary member and the top of the jack. The running gear of the jack is then placed adjacent the base and the third chain is attached to the second chain at a first location. The jack is then cranked to move the running gear away from the base toward the top producing force in the second and third chains to move the object. The first chain is then fully extended and attached to the second chain. The running gear is then moved away from the top and down to the base to release the tension in the third chain and transfer the tension to the first chain. Next the third chain is reattached to the second chain but at a location closer to the object than the first attachment location and then the jack is cranked to move the running gear away from the base toward the top providing force in the second and third chains to further move the object.

Another embodiment of the process of the present invention involves attaching a first line to a jack, connecting a second line to the object be winched, connecting a third line to the running gear of the jack, immobilizing the jack, connecting the third line to the second line and cranking the jack to move the object, and connecting the first line to the second line to hold the object in its new position.

Still another embodiment of the invention involves a process for winching. The process comprises attaching a first line to the base of a jack, connecting a second line to the object to be winched, connecting a third line to the running gear of the jack, connecting a fourth line between the stationary member and the top of the jack, connecting the third line to the second line at a first location and cranking the jack to move the object, connecting the first line to the second line to hold the object in its new position, and reattaching the third line to the second line but at a location closer to said object than said first location for further movement of said object.

One embodiment of the apparatus of the present invention is a jack including a bar having a base and a top. There is provided running gear mounted on the bar and movable between the base and the top. A winch tensioner bracket is mounted on the bar at the base. A first chain and a first hook is mounted on the winch tensioner bracket. A second chain is adapted to be connected to the object to be winched. A winch jack attachment bracket is mounted on the running gear. There is also provided a third chain and a second hook mounted on said winch jack attachment bracket. Finally, each of the first and second hooks are connectable to said second chain.

Still a further embodiment of the apparatus of the present invention involves a jack including a bar having a base and a top. Running gear is mounted on the bar and is movable between the base and the top. A winch tensioner bracket is mounted on the bar at the base. A first chain and first grab hook are mounted on the winch tensioner bracket and a second chain is adapted to be connected to an object to be winched. A winch jack attachment bracket is mounted on the running gear. A third chain and second grab hook are mounted on the winch jack attachment bracket. Each of the first and second hooks are connectable to said second chain.

Still another embodiment of the apparatus of the present invention involves apparatus for holding an object being winched in a new position to which it has been winched. The apparatus involves a winch tensioner bracket, a grab hook and a chain connecting the bracket and the grab hook.

DESCRIPTION OF THE PREFERRED EMBODIMENT

Figure 1:
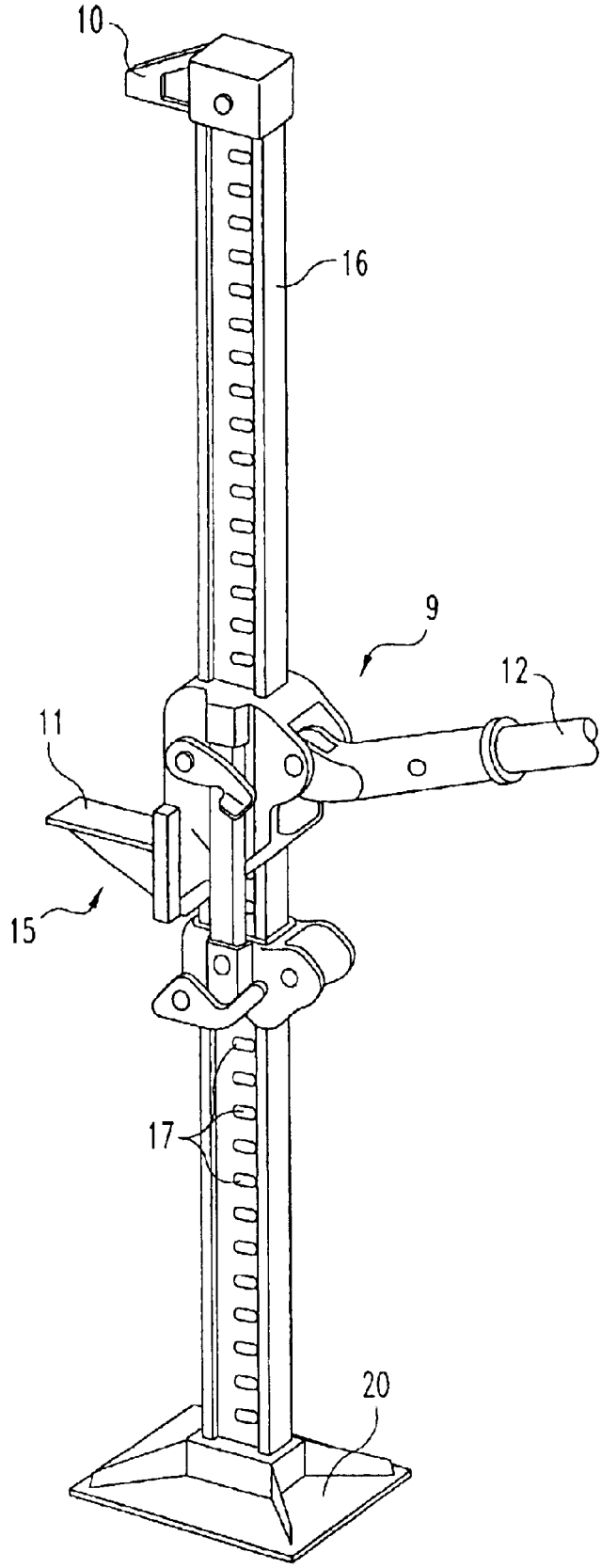
FIG. 1 is a perspective view of a jack usable in the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
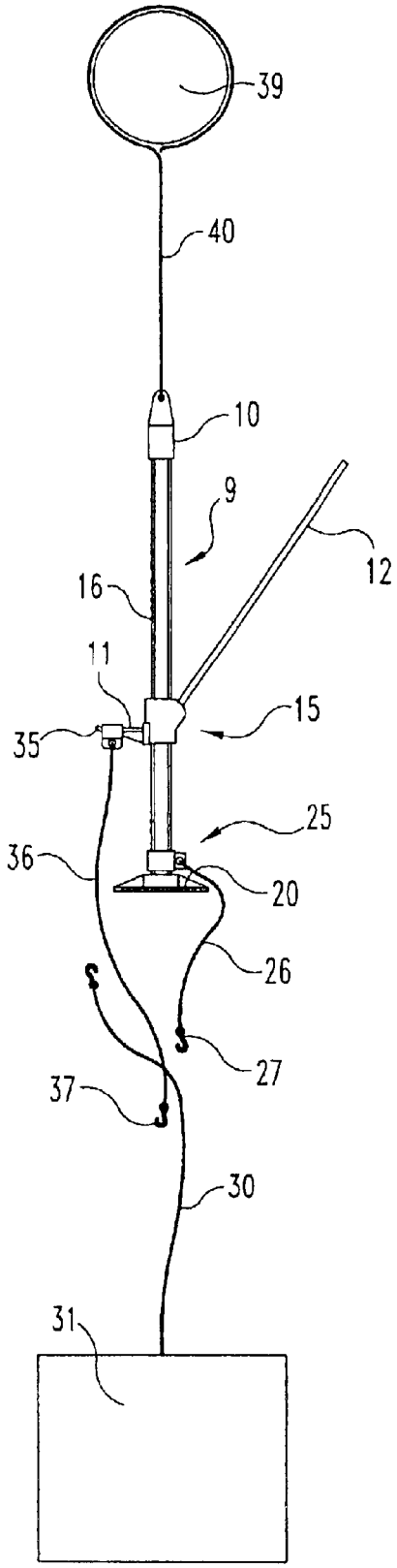
FIG. 2 is a schematic illustration of the method and apparatus of the present invention.

Referring to FIGS. 1 and 2 a jack 9 is illustrated as having a top 10 and a base 20. The jack has running gear 15 including the nose 11. A winch tensioner bracket 25 is mounted on the bar next to the base 20. The winch tensioner bracket 25 has one end of a first chain 26 secured thereto. A grab hook 27 is mounted on the other end of the first chain 26. There is also provided a second chain 30 which is connected to the object 31 such as a vehicle or the like that is to be winched. A winch jack attachment bracket 35 is mounted on the nose 11 of the running gear and has a third chain 36 mounted thereon and extending therefrom. The third chain 36 has a grab hook 37 at its distal end. A fourth chain 40 is connected at one end to the top 10 of the jack and is connected at the other end to a stationary or immovable object 39.

Figure 3:
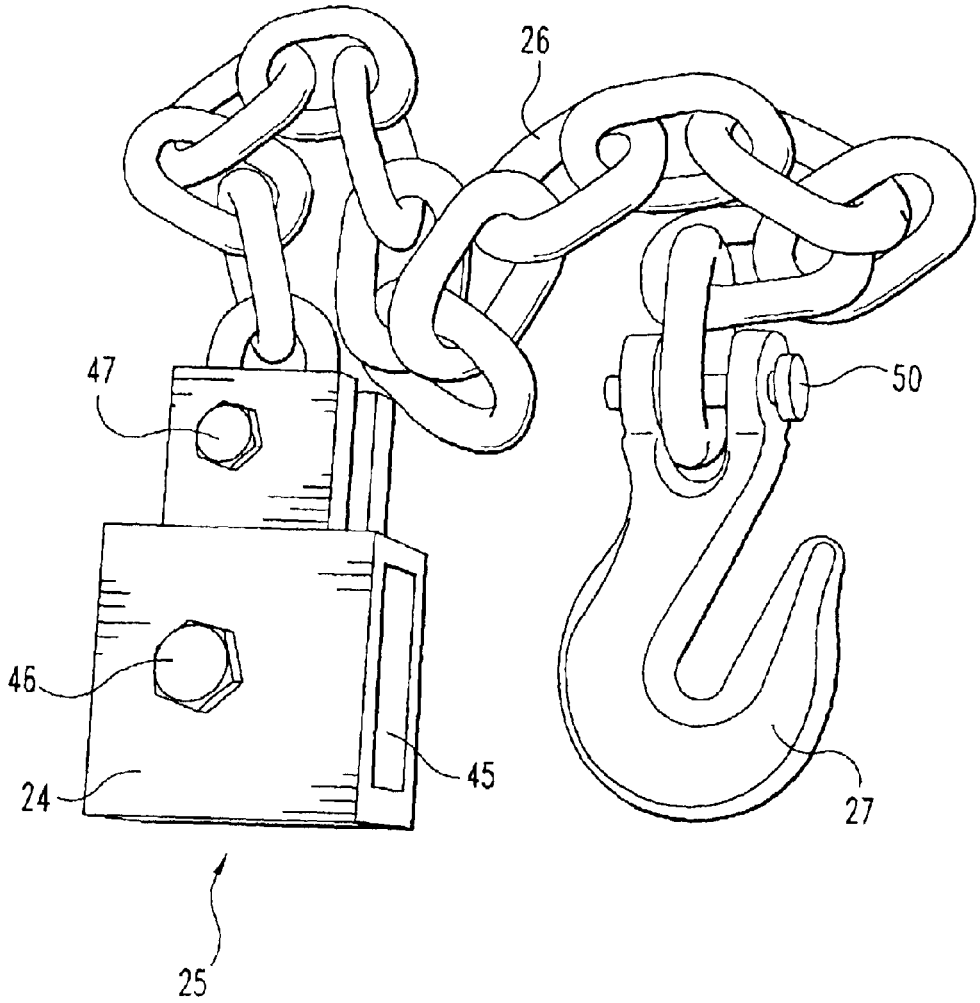
FIG. 3 is a perspective view of the winch tensioner bracket and chain of the present invention.

Referring to FIG. 3 the winch tensioner bracket 25 is shown in more detail as including a casting 24 having a rectangular passage 45 therethrough that fits the shape of the bar 16 of the jack. The winch tensioner bracket 25 is mounted adjacent the base 20 of the jack by means of a bolt 46 which extends through an appropriate aperture 17 in the jack. The first chain 26 has one end attached to the winch tensioner bracket by means of bolt 47. The grab hook 27 is attached to the other end of the chain 26 by bolt 50.

Figure 4:
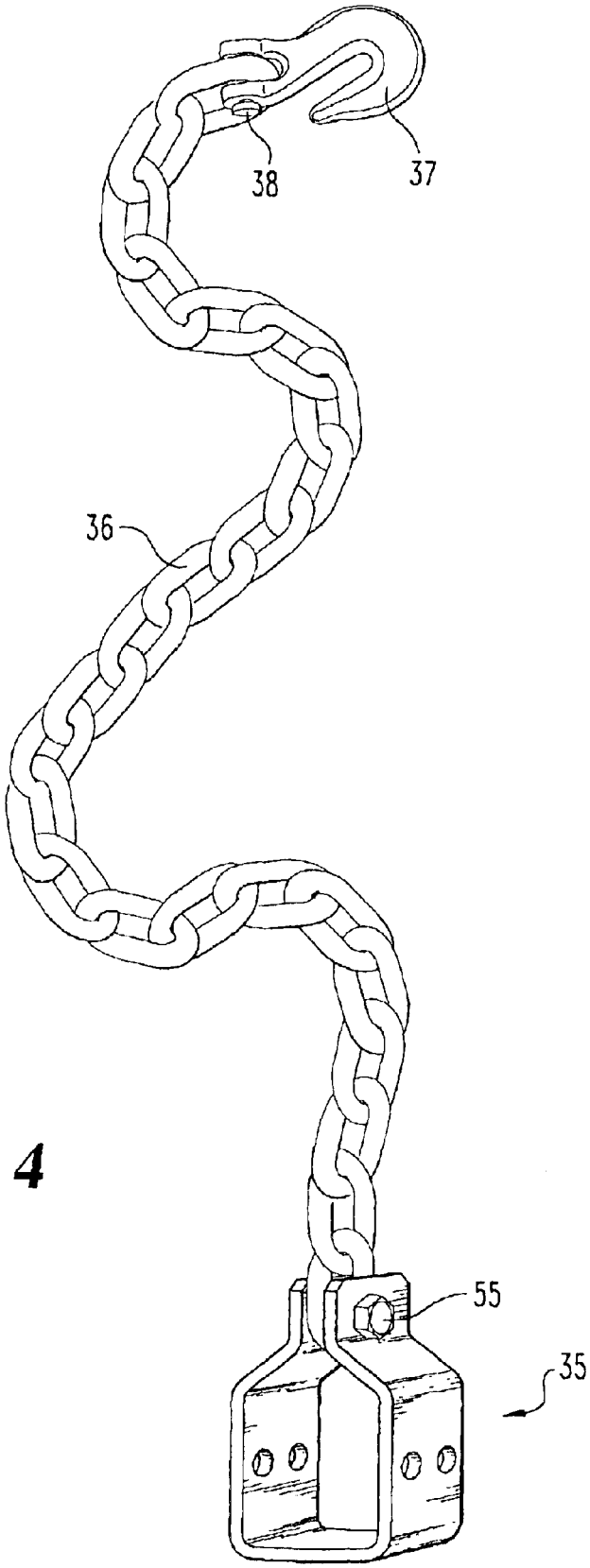
FIG. 4 is a perspective view of a winch jack attachment bracket and chain forming a part of the present invention.

FIG. 4 shows in detail the winch jack attachment 35 the third chain 36 and the grab hook 37. The winch jack attachment 35 is formed from a sheet of relatively heavy steel into the shape illustrated and is bolted to the chain 36 by the bolt 55. The grab hook 37 is bolted to the chain 36 by bolt 38.

In order to move the vehicle, the running gear 15 of the jack is placed in the lower start position adjacent to the base or foot piece 20 and the chain 36 is hooked to the chain 30 (See FIG. 2). As long as there is no force on the nose 11 or the jack running gear 15, the running gear may be slid easily to the start position adjacent the foot piece. The jack is then cranked by pumping the handle 12 back and forth so that the running gear moves away from the base 20 or foot piece. After the slack is removed from the chains 30, 36 and 40, the vehicle will start to pull or winch in the direction of the stationary object or. tree 39. After the running gear is moved the full length of the jack's bar, the chain 26 is fully extended toward the vehicle 31 or other object to be winched and is hooked to the chain 30. The jack's running gear is then cranked down releasing the force exerted on the chain 36 and transferring tension to the chain 26. After the tension has been transferred, the jack's running gear can return or be slid very quickly to the lower or start position adjacent the foot piece. Also, the hook 37 on the chain 36 is disconnected from the chain 30. No chocks are required because the chain 26 is holding the gained ground. The free hook 37 of the chain 36 is then reattached to the chain 30 but at a point closer to the vehicle and the process is repeated until the vehicle is moved as close as desired to the foot piece or base of the jack.

Figure 5:
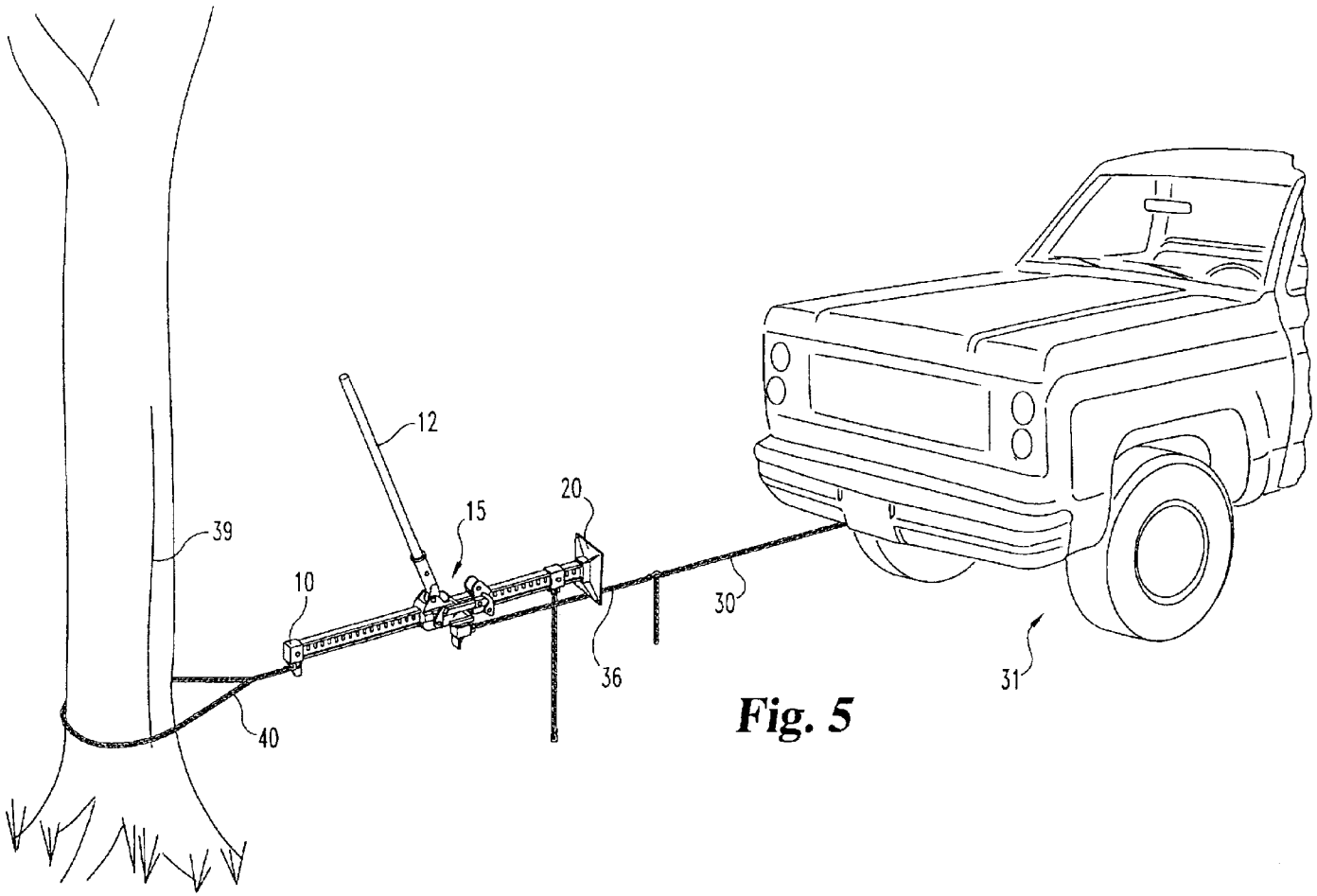
FIG. 5 is a perspective view of the method and apparatus of the invention showing the winch jack attachment bracket and chain in use.

FIG. 5 shows the apparatus of the present invention in use. Although the invention is usable to winch any type of object, FIG. 5 shows winching of a vehicle 31. Also in FIG. 5 the chain or line 40 is connected to a tree 39 which could also be some other stationary object. FIG. 5 shows the third chain (line) 36 in tension and connected to the second chain (line) 30. FIG. 5 illustrates the step of the winching method wherein the vehicle is moved by cranking the handle 12 of the jack causing the running gear to move away from the base 20 and toward the top 10.

Figure 6:
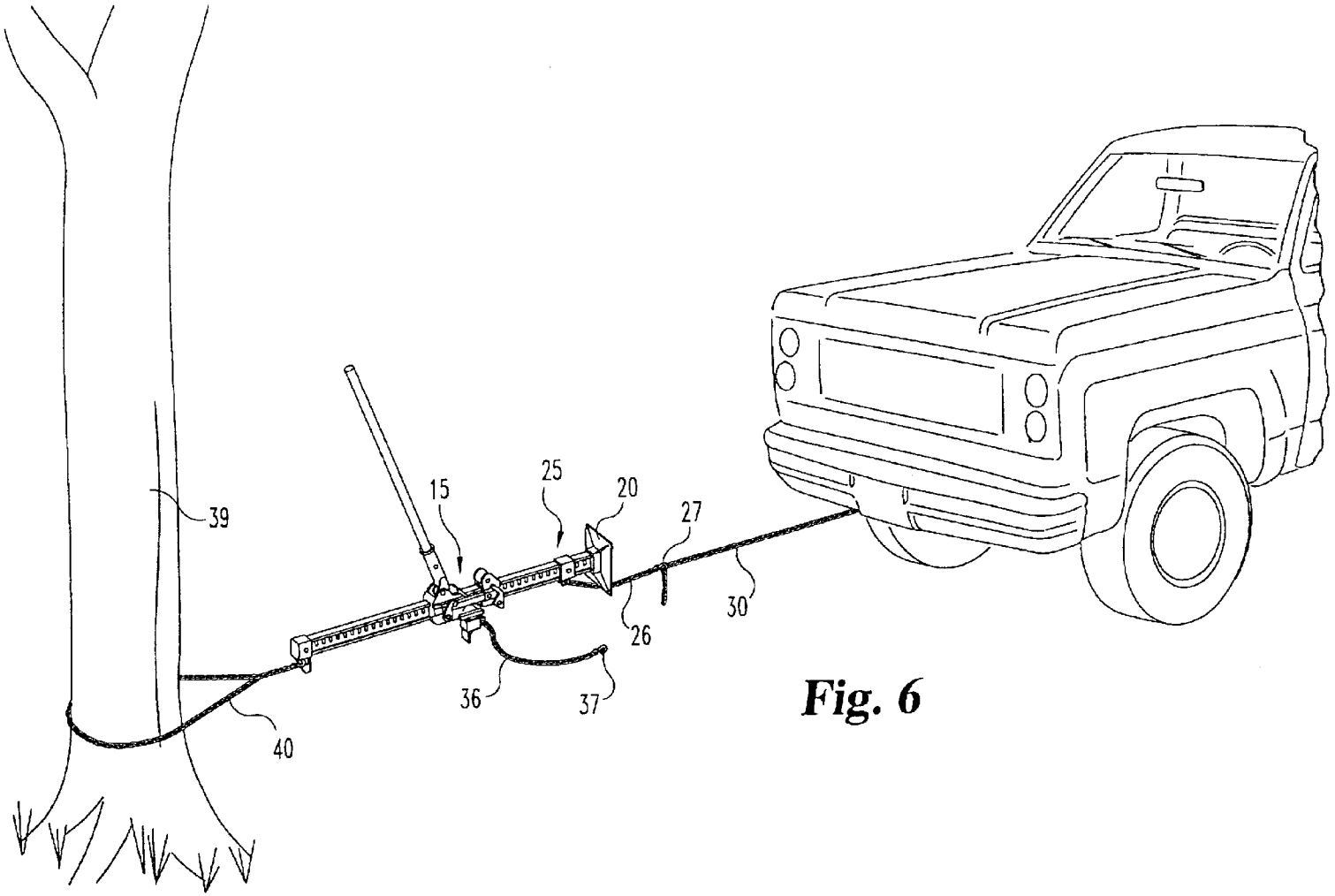
FIG. 6 is a similar view of FIG. 5 but showing the winch tensioner bracket and chain in use.

FIG. 6 also shows the apparatus of the present invention in use. In FIG. 6 the winch tensioner bracket 25 and its associated first chain (line) 26 and grab hook 27 is shown in tension and connected to the second chain (line) 30. FIG. 6 illustrates the step of the winching method wherein the vehicle is held in position permitting the jack's running gear 15 to be cranked down releasing the force exerted on the chain 36 and transferring the tension to the chain 26. The free hook 37 of the chain 36 can then be reattached to the chain 30 but at a point closer to the vehicle so that the vehicle can be moved closer to the base of the jack. Thus each of chain 36 and 26 may be placed in tension, alternately, moving and holding the vehicle. This process is carried out until the vehicle is moved the desired distance.

While the invention has been illustrated and described above in detail in the drawings and foregoing description, the same is to be considered as illustrative and not restrictive in character, it being understood that only some of the preferred embodiments have been shown and described and that all changes and modifications that come within the spirit of the invention are desired to be protected.

For example, one of the embodiments described above involves a series of chains, namely, a first, second, third and fourth chain. Such chains might be replaced by a series of lines. The lines could be manufactured of fabric of the type used in commercially available tow ropes but have a series of apertures in the lines permitting reattachment of grab hooks at various locations along the lines. The term line in the claims is used generically to include chain. Also the process of this invention can be practiced with other types of jacks other than the preferred embodiments of jacks as described above. Also other types of winch jack attachments and winch tensioners can be used in the process of the invention so long as they provide effective and secure attachment to the working parts of the jack and also provide secure attachment to the lines. Also other devices for attaching to the lines may be used in the process in place of grab hooks, for example, secure knots.

What is claimed:

1. Apparatus for winching comprising a jack including a bar having a base and a top, running gear mounted on said bar and movable between said base and top, a winch tensioner bracket mounted on said bar at said base, a first chain and first hook mounted on said winch tensioner bracket, a second chain adapted to be connected to an object to be winched, a winch jack attachment bracket mounted on the running gear, a third chain and second hook mounted on said winch jack attachment bracket, each of said first and second hooks being connectable to said second chain.

2. The apparatus of claim 1 wherein said winch tensioner bracket has a rectangular recess which receives the bar of said jack, a bolt extending through said winch tensioner bracket and said bar securing said winch tensioner bracket to said bar at said base.

3. The apparatus of claim 2 wherein said first grab hook is bolted to one end of said first chain and said winch tensioner bracket is bolted to the other end of said first chain.

* * * * *